United States Patent [19]

Hogan

[11] Patent Number: 4,976,115

[45] Date of Patent: Dec. 11, 1990

[54] CAMBERED CONDENSER GRILL

[75] Inventor: Mark R. Hogan, Manlius, N.Y.

[73] Assignee: Carrier Corporation, Syracuse, N.Y.

[21] Appl. No.: 396,264

[22] Filed: Aug. 21, 1989

[51] Int. Cl.[5] ..... F25D 17/06

[52] U.S. Cl. ..... 62/428; 62/507; 98/40.2

[58] Field of Search ..... 62/428, 429, 507, 183, 62/184; 98/40.2, 104

[56] References Cited

U.S. PATENT DOCUMENTS

| | | | |
|---|---|---|---|
| 1,753,944 | 4/1930 | Replogle | 62/428 X |
| 1,883,607 | 10/1932 | Dennedy | 62/507 |
| 2,560,802 | 7/1951 | Lambert | 98/40.2 |
| 2,654,227 | 10/1953 | Muffly | 62/429 X |
| 2,920,464 | 1/1960 | Trask | 62/428 |
| 3,299,650 | 1/1967 | Kramer | 62/507 X |

*Primary Examiner*—William E. Tapolcai
*Attorney, Agent, or Firm*—Robert H. Kelly

[57] ABSTRACT

An outdoor grill assembly for use in conjuction with an axial fan is disclosed. The assembly has cambered grill elements which increase the fan efficiency and lower the noise level associated with the fan. A grill having mirror image sections of cambered elements also controls recirculation of air from the discharge to the inlet.

6 Claims, 1 Drawing Sheet

CAMBERED CONDENSER GRILL

BACKGROUND OF THE INVENTION

This invention relates generally to an airflow deflecting assembly, and more specifically, is directed to an outdoor grill for an air conditioning unit having cambered grill elements oriented to control recirculation while reducing air-side losses and while reducing the noise produced by operation of an axial fan.

Air conditioning units, including heat pump units, which are commonly used for light commercial applications such as hotels, dormitories, and office buildings are often of the type known as a packaged terminal air conditioner (PTAC). These packaged terminal air conditioners extend through the wall of the enclosure and normally have an evaporator section in communication with the enclosure air for conditioning said air as it is drawn through the unit. A condensing section or outdoor section is located in communication with the outdoor ambient air for discharging heat energy during the cooling cycle. As with most air conditioning units a portion of the unit, having an indoor coil, is located within the enclosure to be conditioned while another portion of the unit, having an outdoor coil, is located in communication with the outdoor air. A grill structure is normally installed over each portion to prevent the entry of foreign objects while allowing the free flow of air to and from the portions. The axial fan on the outdoor side of the PTAC or other similar unit normally has a flat louvered grill as shown in U.S. Pat. No. Des. 267,338 and U.S. Pat. No. Des. 267,339 or a wire ring grill as shown in U.S. Pat. 4,818,183. If the louvers are parallel to the exhaust air stream, then control of recirculation from the discharge to the inlet is completely lost.

Moreover, if the louvers are pitched at a straight angle to the exhaust air stream, then turning losses and form drag losses are increased. Thus, although a straight angled grill reduces recirculation, the turning losses and form drag losses increase the pressure losses and hence, noise increases and fan power increases.

SUMMARY OF THE INVENTION

Therefore, it is an object of the present invention to provide an outdoor grill which overcomes the drawbacks of the prior art.

It is another object of the present invention to provide a grill for an outdoor coil and fan to increase the fan efficiency and lower the noise level associated with the outdoor unit.

It is yet another object of the present invention to provide an outdoor grill of an air conditioning unit with cambered grill elements which minimize the air side pressure drop.

It is still another object of the present invention to provide an outdoor grill of an air conditioning unit with mirror image sections of cambered elements to reduce recirculation of air.

These and other objects are achieved according to a preferred embodiment of the present invention by providing a cambered grill for an outdoor air conditioning unit in which the discharge air from the fan mounted in the airstream flowing through the outdoor heat exchanger is arranged to blow air through the grill to the outdoor ambient. The grill elements or louvers are cambered so that the upstream portion of the element is parallel to the discharge air from the fan while the downstream portion of the element, which is connected to the upstream portion by an arching curved portion, discharges the air at an angle from the center line of the fan.

The various features of novelty which characterize the invention are pointed out with particularity in the claims annex to and forming a part of this specification. For a better understanding of the invention, its operating advantages, and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

The preferred embodiment described herein refers to a cambered outdoor grill as applied to a packaged terminal air conditioner. It is to be understood, however, that this invention has like applicability to the outdoor portion of room air conditioners or split air conditioners or heat pumps.

Figure 1:
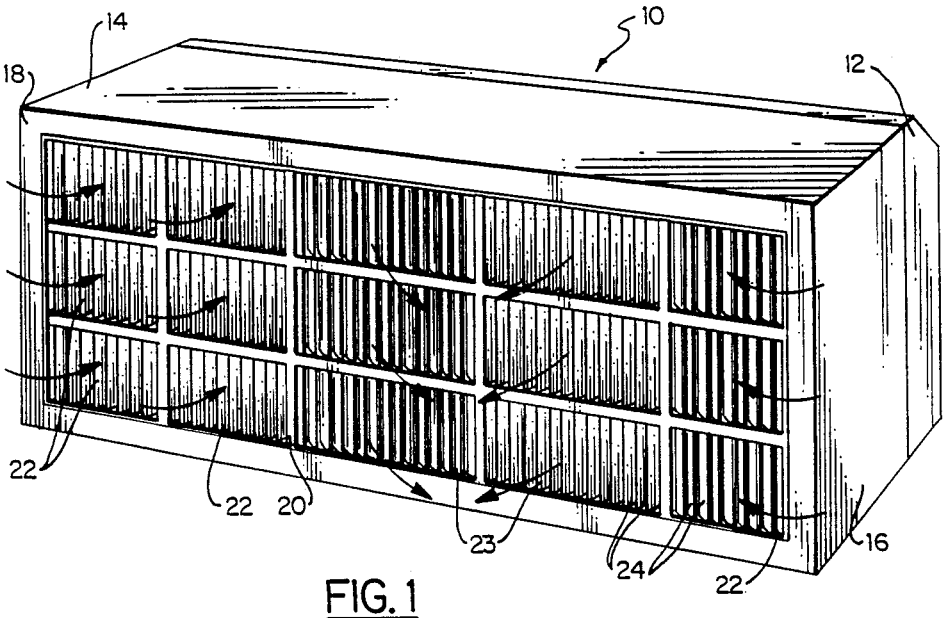
FIG. 1 is a perspective view of rear or outdoor portion of a packaged terminal air conditioning unit utilizing the present invention.

Referring to FIG. 1, there may be seen a packaged terminal air conditioning unit 10 having a front cover 12 and a rear cover 14. Rear cover 14 has a plurality of sides 16 and a back portion 18 with an opening therethrough for directing outside air through an outdoor coil. A discharge grill 20 is shown attached to the opening in the back of the rear cover 16. The discharge grill 20 has a plurality of louvered sections 22 including stationary cambered elements 24 for guiding air into and out of the unit while controlling recirculation. In the outdoor unit of a split air conditioner or in room air conditioners, the inlet section may be on the side opposite the discharge grill section or on the side of the unit.

Figure 2:
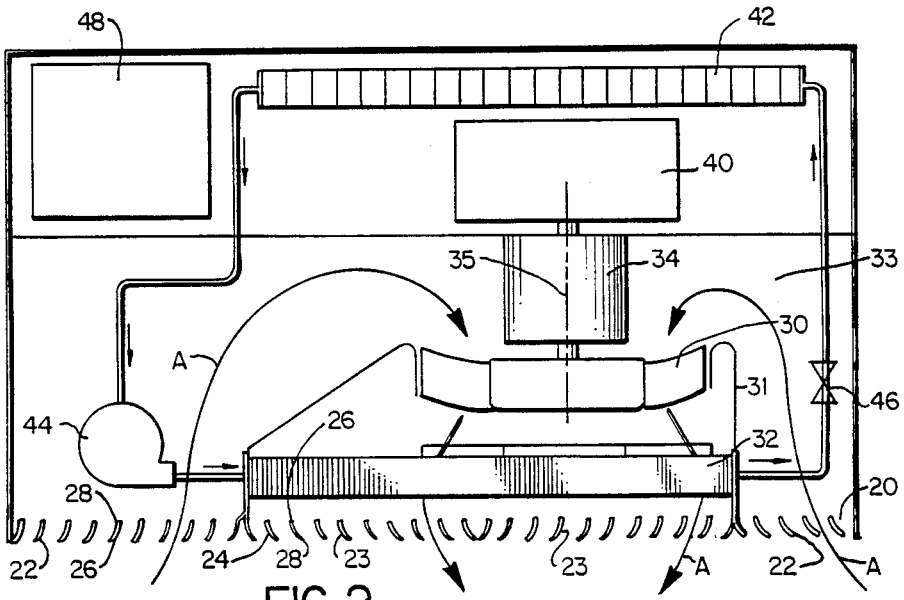
FIG. 2 is a schematic top plan view of the packaged terminal air conditioning unit of FIG. 1.

Referring now to FIG. 2, there may be seen the outdoor air flow path of a package terminal air conditioning unit. Axial condenser fan draws outside air through the sides of the outdoor grill 20 and around shroud 31. The air then flows through the axial fan 30 and is discharged outwardly generally parallel to the axis 35 of the axial fan 30 through condenser coil 32 and outdoor grill 20, which is generally perpendicular to the axis 35 as shown by flow arrows. The axial fan 30 is driven by a motor 34 mounted behind the fan. The fan is connected to the motor by means of a drive shaft 36. The motor 34 is also adapted to drive a centrifugal fan 40 for moving indoor air through an evaporator or indoor coil 42, mounted in the indoor section of the PTAC. As is known in the art, the condenser coil 32 and evaporator coil 42 are connected into a refrigerant loop along with a compressor 44 and an expansion valve 46 to complete the air conditioning circuit. Generally, a control system 48, accessible through the front cover 12, controls the operation of the PTAC.

With the structure illustrated in FIGS. 1 and 2, outdoor air flow is drawn through cambered louvered inlet sections 22 around the outside of the shroud 31 through passageway 33, and through the axial fan 30 and condenser coil 32 whereupon it is discharged through cambered louvered discharge sections 23 of the outdoor grill 20. The mirror image portion of the cambered elements 24 of the inlet sections 22 and the discharge sections 23 of the discharge grill guide the outdoor air in and out of the PTAC while controlling recirculation. The camber of the elements 24 is determined by orienting the leading edges 26 and the trailing edges 28 with the desired or given inlet or discharge flow velocity streams or vectors. The mirror image portion of the discharge elements 24 generally have their trailing edges 28 fixed whereby the air discharged from the mirror image portions converge towards the axis 35 of the axial fan as shown by the flow arrows "A". Thus, the cambered grill of this invention imposes less work on the airstream, thereby, decreasing fan shaft power and fan noise. This has at least two (2) beneficial effects: the fan rotation speed can be reduced while providing the same flow (C.F.M.), and/or the power (BHP) of the motor can be reduced. Accordingly, any reduction in fan speed will also reduce fan noise.

Prior art grills having straight louver elements perpendicular to the discharge face of the condenser grill or parallel to the discharge air stream vector could not control recirculation, while those having straight louver elements angled from the air stream vector, to eliminate recirculation, had excessive air-side losses.

In order to allow a comparison of the improved cambered element grill of the present invention to prior art straight element grills, the following tables are provided to describe various parameters and performance results.

TABLE I

| | FLOW (CFM) | SPEED (RPM) | POWER (BHP) |
|---|---|---|---|
| Straight Element | 576.6 | 1145 | 0.114 |
| Camber Element | 601.8 | 1146 | 0.115 |

TABLE II

Performance Characteristics scaled to 540 CFM.

| | FLOW (CFM) | SPEED (RPM) | POWER (BHP) |
|---|---|---|---|
| Straight Element | 540 | 1070 | 0.093 |
| Camber Element | 540 | 1026 | 0.083 |

It can be seen from Table I that the cambered element grill has a higher flow rate through the outdoor section when the speed of the axial fan is held constant. Furthermore, it can be seen from Table II that when the flow is scaled to a constant 540 CFM, the speed of the axial fan with the cambered grill elements is reduced 4.1% while the power is reduced 11%. This represents a reduction in sound due to the lower speed of 1.02dBA.

Based on the test results, the present invention reduces air-side losses in the outdoor section of a heat transfer unit while controlling recirculation. Further, these test results show an appreciable increase in air flow rate with a constant speed which can be converted to a reduction in fan speed while maintaining a constant air flow rate.

Hence, as has been described herein, an outdoor grill having cambered elements to prevent recirculation of the condenser discharge into the fan inlet stream will reduce air-side pressure losses, which affect fan shaft power and fan noise.

The invention has been described with reference to a particular embodiment, however, it is to be understood by those skilled in the art, that variations and modifications can be made within the spirit and scope of the invention. For example, the length and vertical orientation of the cambered elements can be changed for particular applications.

What is claimed is:

1. An outdoor portion of an air conditioning unit of the type having a heat exchanger and an axial fain that moves air from an outdoor environment through the heat exchanger and back to the outdoor environment, the outdoor portion including:

air passage means having an upstream inlet passage for allowing movement of the air from the outdoor environment to an inlet region of the axial fan, and a downstream discharge passage spaced from the axial fan in an axial direction for allowing movement of the air discharged from the axial fan to the outdoor environment, and a planar grill means located in both said downstream discharge passage and said upstream inlet passage in a plane perpendicular to an axis of the axial fan including first and second discharge sections and an inlet section, each discharge section having a plurality of nonadjustable grill elements for guiding the air discharged from the axial fan to said outdoor environment, said nonadjustable grill elements of said discharge sections having a leading edge portion, a trailing edge portion and a cambered portion connecting said leading edge portion to said trailing edge portion, said first and second discharge sections being substantially mirror images of one another about a plane parallel to said axis of the axial fan, whereby all of the air moving through said first section converges toward all of the air moving through said second section and said inlet section having a plurality of nonadjustable grill elements for guiding air from the outdoor environment into said inlet region of said axial fan, said nonadjustable grill elements of said inlet section having a leading edge portion, a trailing edge portion and a cambered portion connecting said leading edge portion to said trailing edge portion, whereby said leading edge portion of said grill elements of said inlet section are oriented oppositely of said trailing edge portion of the discharge section next adjacent said inlet section to control recirculation.

2. An outdoor portion of an air conditioning unit as set forth in claim 1, wherein said trailing edge portion of all the elements of said first discharge section are cambered toward said trailing edge portion of all of the elements of said seconded discharge section.

3. A packaged terminal air conditioner extending through a wall or the like of an enclosure to be conditioned, comprising:

a cabinet having an outdoor portion and an indoor portion therein;

an axial fan and a heat exchanger located in said outdoor portion of said cabinet and forming an air passage means, said air passage means is adapted to allow outdoor air to enter an inlet portion of the air passage means and pass through said axial fan and said heat exchanger and to enter a discharge portion of the air passage means, and exit said discharge portion, and a planar outdoor grill mounted in said cabinet, said grill located in a plane perpendicular to an axis of said axial fan and including at least one inlet section and an outlet section positioned adjacent to said inlet section, said inlet section and said outlet section having a plurality of cambered nonadjustable grill elements, said grill elements having a leading edge portion, a trailing edge portion downstream of said leading edge portion, and a cambered portion connecting said leading edge portion and said trailing edge portion.

4. A packaged terminal air conditioner as set forth in claim 3 wherein said outlet section is located at said discharge portion of said air passage means and said outlet section includes first and second segments, and said leading edge portion of said first and second segments and said trailing edge portion of said inlet section is generally parallel to a plane through said axis of said axial fan.

5. A packaged terminal air conditioner as set forth in claim 4 wherein said outlet section includes first and second mirror image segments whereby the trailing edge portion of both first and second mirror image segments are cambered toward said plane through said axis and axial fan whereby all the air moving through said first segment converges toward all the air moving through said second segment.

6. A packaged terminal air conditioner as set forth in claim 5 wherein said inlet section is located at said inlet portion of said air passage means, and said trailing edge portion is generally parallel to the leading edge portion of the grill elements located at said discharge portion.

* * * * *